US005743565A

United States Patent [19]

Zimmanck

[11] Patent Number: 5,743,565

[45] Date of Patent: Apr. 28, 1998

[54] NOTE PAD HOLDER

[76] Inventor: Jack Zimmanck, 1112 Applebriar, Marlboro, Mass. 01752

[21] Appl. No.: 804,323

[22] Filed: Feb. 21, 1997

[51] Int. Cl.[6] ..... B42D 17/00

[52] U.S. Cl. ..... 281/44; 281/15.1; 281/45

[58] Field of Search ..... 281/15.1, 21.1, 281/38, 44, 45, 51

[56] References Cited

U.S. PATENT DOCUMENTS

| | | | |
|---|---|---|---|
| 5,100,178 | 3/1992 | MacKelvie | 281/44 |
| 5,112,083 | 5/1992 | Morrone | 281/44 |
| 5,174,607 | 12/1992 | Hill | 281/44 |

*Primary Examiner*—Willmon Fridie, Jr.
*Attorney, Agent, or Firm*—Brian M. Dingman

[57] ABSTRACT

A note pad holder for removably holding a note pad of the type having a binding which grips a pad comprising a number of sheets of paper proximate or along one edge of the pad, the binding having an overlap portion which overlaps a small portion of the pad along the gripped edges of the sheets thereof to create an edge strip which is thicker than the remainder of the note pad. The note pad holder is designed to be removably attached to a surface such as a refrigerator front. The note pad holder comprises an elongated, generally "U" shaped channel defining an opening which is smaller than the thickness of the pad edge strip, the channel comprising a base section and front and rear wall sections extending therefrom, to define generally parallel interior wall surfaces, with the front interior wall surface at least as long as the width of the binding overlap portion, the front wall ending in a binding-retaining section defining a binding-retaining wall surface extending from the front interior wall surface toward the rear interior wall surface, and ending at a distance from the rear interior wall surface which is less than the thickness of the pad edge strip, and at least about as great as the thickness of the remainder of the note pad, to retain the edge strip within the channel.

13 Claims, 1 Drawing Sheet

NOTE PAD HOLDER

FIELD OF THE INVENTION

This invention relates to a note pad holder which can removably hold a standard legal pad, or similar pad with an enlarged binding, to a vertical metal surface, such as a refrigerator front, or a file cabinet.

BACKGROUND OF THE INVENTION

Notes and lists are often generated in the kitchen. Many homeowners keep a pad of paper and a pen or pencil in a kitchen drawer or on a table or counter top. In these locations, it is often the case that one or both of the pad and writing instrument become misplaced. Many people can identify with the frustration of searching for the missing necessity, a situation which is exacerbated when the user is on the telephone.

Almost every kitchen in the United States has a refrigerator with a door or two which provides a large, flat, vertical metal surface which is an ideal location for a pad of paper and a writing instrument. Accordingly, it would be desirable to provide a means of supporting a pad of paper and a writing instrument on a refrigerator surface, or another vertical surface. It would also be desirable that the pad and writing instrument be easily removable from the refrigerator surface, so that the pad can also be placed on a horizontal surface for use.

SUMMARY OF THE INVENTION

It is therefore an object of this invention to provide a note pad holder which removably holds a note pad to a ferromagnetic surface such as a refrigerator front or a filing cabinet.

It is a further object of this invention to provide such a note pad holder which is easily removed from the ferromagnetic surface.

It is a further object of this invention to provide such a note pad holder which allows a new pad to be installed very easily.

It is a further object of this invention to provide such a note pad holder which includes a writing instrument holder which is also removably held to a ferromagnetic surface.

This invention features a note pad holder for removably holding a note pad of the type having a binding which grips a pad comprising a number of sheets of paper proximate or along one edge of the pad, the binding having an overlap portion which overlaps a small portion of the pad along the gripped edges of the sheets thereof to create an edge binding strip which is thicker than the remainder of the note pad. Such note pads include, but are not limited to, standard letter and legal-size pads, standard junior legal pads, and any other pad with an enlarged pad edge binding strip which can be retained in a note-pad holder opening of the type described herein. The note pad holder is adapted for attachment to a surface, preferably a ferromagnetic surface. The note pad holder comprises an elongated, generally "U" shaped channel defining an opening which is smaller than the thickness of the pad edge binding strip, the channel comprising a base section and from and rear wall sections extending therefrom, to define generally parallel interior wall surfaces, with the front interior wall surface at least as long as the width of the binding overlap portion, the front wall ending in a binding-retaining section defining a binding-retaining wall surface extending from the front interior wall surface toward the rear interior wall surface, and ending at a distance from the rear interior wall surface which is less than the thickness of the pad edge binding strip, and greater than, or at least approximately equal to, the thickness of the remainder of the pad, to retain the edge binding strip within the channel.

The opening in the channel may be coextensive in length with the channel, to allow the note pad to be slid into the channel from either end of the channel. The length of the channel is preferably about the same as the width of the note pad, although this is not a necessary limitation, as the pad can be wider than, or narrower than, the channel.

The interior wall surfaces may be parallel. The binding-retaining wall surface may be generally perpendicular to the front interior wall surface. The rear wall section may be longer than the front wall section.

The rear wall section may further define an elongated, outward-facing opening. A magnetic means, which may include a strip magnet, or one or more other magnet shapes, may be fixed to the channel, and preferably held within such outward-facing opening, to allow the note pad holder to adhere to a ferromagnetic surface. The elongated opening may be coextensive in length with the channel. The elongated opening is preferably a recess in the outer portion of the rear wall section.

In a more specific embodiment, this invention features a note pad holder for removably holding a note pad of the type having a binding which grips a pad comprising a number of sheets of paper proximate or along one edge of the pad, the binding having an overlap portion which overlaps a small portion of the pad along the gripped edges of the sheets thereof to create an edge binding strip which is thicker than the remainder of the note pad. The note pad holder comprises an elongated, generally "U" shaped channel defining an opening which is smaller than the thickness of the pad edge binding strip, the channel comprising a base section and front and rear wall sections extending therefrom, to define generally parallel interior wall surfaces, with the front interior wall surface at least as long as the width of the pad binding overlap portion, the front wall ending in a binding-retaining section defining a binding-retaining wall surface extending from the front interior wall surface toward the rear interior wall surface, and ending at a distance from the rear interior wall surface which is less than the thickness of the pad edge strip, and at least about as great as the thickness of the remainder of the note pad, to retain the edge strip within the channel, the binding-retaining wall surface being generally perpendicular to the front interior wall surface; and magnetic means along the rear wall section, to allow the note pad holder to adhere to a ferromagnetic surface.

BRIEF DESCRIPTION OF THE DRAWINGS

Other objects, features and advantages will occur to those skilled in the art from the following description of a preferred embodiment, and the accompanying drawings, in which.

DESCRIPTION OF THE PREFERRED EMBODIMENT

This invention may be accomplished in a note pad holder which removably holds a note pad, particularly a "legal pad", which has a binding which grips the pad proximate or along the top edge, and which overlaps a small portion of the top front of the pad to create an edge binding strip which is thicker than the remainder of the note pad. This is accomplished with a pad holder which defines an opening into which the pad can be slid edge on. The interior portion of the opening is about the same width as the pad edge binding strip, and the exterior facing portion of the opening is more narrow, but at least about as great as the remainder of the note pad, to allow the pad to extend out of the opening.

Figure 1:
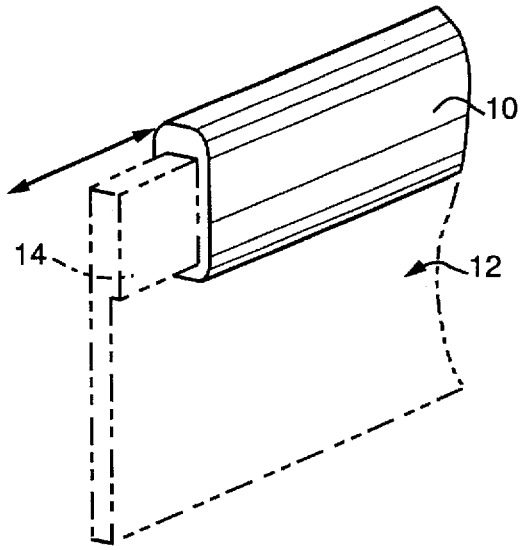
FIG. 1 is a perspective view of a note pad partially inserted in a preferred embodiment of the note pad holder of this invention.
Figure 2:
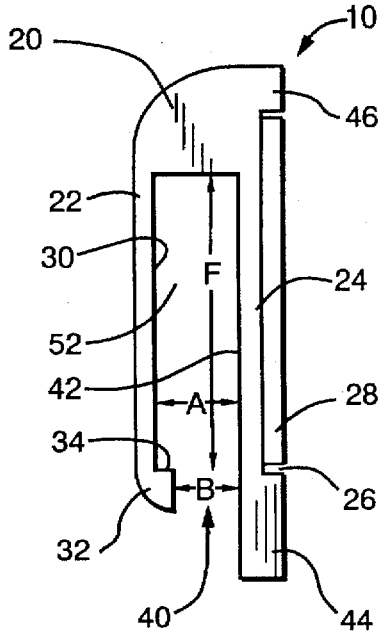
FIG. 2 is an enlarged, end view of the note pad holder of FIG. 1.
Figure 3:
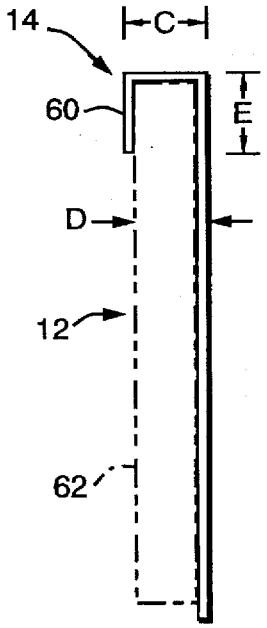
FIG. 3 is a side view of the note pad of FIG. 1.

The preferred embodiment of the note pad holder of this invention is shown in the figures, and comprises elongated, generally "U" shaped channel 10 defining opening 40 which has a width B which is smaller than width C of the edge binding strip of pad 12, FIG. 3, but is at least about as great as, and preferably greater than, the width D of the remainder of the pad. Opening 52 is preferably coextensive in length with channel 10. Internal opening 52 has a larger width A which is at least as large as width C. The height F of opening 52 is at least as long as the width E of binding overlap portion 60. As a result, the edge binding strip of pad 12 fits snugly within opening 52, and is retained therein by binding-retaining wall surface 34 of binding retaining section 32.

Channel 10 comprises base section 20 and depending front and rear wall sections 22 and 24. Wall sections 22 and 24 in this preferred embodiment are essentially parallel and uniform, to define parallel interior wall surfaces 30 and 42, respectively. Front wall section 22 ends in binding-retaining section 32 which defines binding retaining wall surface 34, which is generally perpendicular to interior wall surface 30. Wall surface 34 prevents binding overlap portion 60 from passing out of opening 52; the width B of opening 40 is less than the width C of the pad including binding overlap portion 60.

Figure 4:
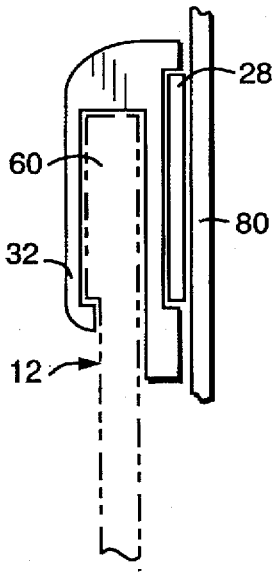
FIG. 4 is a side view of the note pad holder and note pad of FIG. 1 on a vertical surface.
Figure 5:
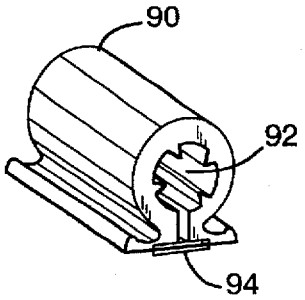
FIG. 5 is a perspective view of a magnetic writing instrument holder, which constitutes a feature of preferred embodiment of this invention.

The rear wall section 24 may be flat or not, but preferably further defines an elongated, outward-facing opening 26 in which is secured magnetic means 28, which in this embodiment comprises a flexible strip magnet which is glued into opening 26, and extends just slightly out of opening 26 so that magnet 28 can contact a ferromagnetic surface such as refrigerator door 80, FIG. 4 or a file cabinet, for example. Opening 26 is preferably coextensive in length with channel 10. Magnetic means 28 has sufficient magnetic strength to hold the pad and holder up on a vertical surface.

Also preferably included is writing instrument holder 90, which is an extruded, slightly expandable plastic channel with through-opening 92 which tightly grips a pen or pencil. Magnet 94 is fixed to holder 90 to allow holder 90 to adhere to a ferromagnetic surface. This keeps a writing instrument handy near the paper pad.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A note pad holder for removably holding a note pad of the type having a binding which grips a pad comprising a number of sheets of paper proximate or along one edge of the pad, the binding having an overlap portion which overlaps a small portion of the pad along the gripped edges of the sheets thereof to create an edge binding strip which is thicker than the remainder of the note pad, the note pad holder comprising:

an elongated, generally "U" shaped channel defining an opening which is smaller than the thickness of the pad edge binding strip, the channel comprising a base section and front and rear wall sections extending therefrom, to define generally parallel interior wall surfaces, with the front interior wall surface at least as long as the width of the binding overlap portion, the front wall ending in a binding-retaining section defining a binding-retaining wall surface extending from the front interior wall surface toward the rear interior wall surface, and ending at a distance from the rear interior wall surface which is less than the thickness of the pad edge binding strip, and at least about as great as the thickness of the remainder of the note pad, to retain the pad edge binding strip within the channel.

2. The note pad holder of claim 1 in which the opening in the channel is coextensive in length with the channel, to allow the note pad to be slid into the channel from either end of the channel.

3. The note pad holder of claim 1 in which the pad has a width which is the same as the edge strip length, and the channel has a length about as long as the edge strip.

4. The note pad holder of claim 1 in which the interior wall surfaces are parallel.

5. The note pad holder of claim 1 in which the binding-retaining wall surface is generally perpendicular to the front interior wall surface.

6. The note pad holder of claim 1 in which the rear wall section is longer than the front wall section.

7. The note pad holder of claim 1 in which the rear wall section further defines an elongated, outward-facing opening.

8. The note pad holder of claim 7 further including magnetic means within the outward-facing opening, to allow the note pad holder to adhere to a ferromagnetic surface.

9. The note pad holder of claim 8 in which the elongated opening is coextensive in length with the channel.

10. The note pad holder of claim 8 in which the elongated opening is a recess in the outer portion of the rear wall section.

11. The note pad holder of claim 1 further including a magnetic writing instrument holder.

12. The note pad holder of claim 1 further including magnetic means fixed to the channel, to allow the note pad holder to adhere to a ferromagnetic surface.

13. A note pad holder for removably holding a note pad of the type having a binding which grips a pad comprising a number of sheets of paper proximate or along one edge of the pad, the binding having an overlap portion which overlaps a small portion of the pad along the gripped edges of the sheets thereof to create an edge binding strip which is thicker than the remainder of the note pad, the note pad holder comprising:

an elongated, generally "U" shaped channel defining an opening which is smaller than the thickness of the pad edge binding strip, the channel comprising a base section and front and rear wall sections extending therefrom, to define generally parallel interior wall surfaces, with the front interior wall surface at least as long as the width of the binding overlap portion, the front wall ending in a binding-retaining section defining a binding-retaining wall surface extending from the front interior wall surface toward the rear interior wall surface, and ending at a distance from the rear interior wall surface which is less than the thickness of the pad edge binding strip, and at least about as great as the thickness of the remainder of the note pad, to retain the pad edge binding strip within the channel, the binding-retaining wall surface being generally perpendicular to the front interior wall surface; and magnetic means along the outside of the rear wall section, to allow the note pad holder to adhere to a ferromagnetic surface.

* * * * *